United States Patent [19]

LeClaire

[11] Patent Number: 4,829,194

[45] Date of Patent: May 9, 1989

[54] DEVICE FOR DETECTING THE VARIATION OF THICKNESS OF A FABRIC AND A PROCESS FOR CALIBRATING SAME

[75] Inventor: Charly LeClaire, Dourges, France

[73] Assignee: Prouvost S.A., Roubaix, France

[21] Appl. No.: 869,874

[22] Filed: Jun. 3, 1986

[30] Foreign Application Priority Data

Jun. 3, 1985 [FR] France ..... 85 08317

[51] Int. Cl.[4] ..... G01M 21/86

[52] U.S. Cl. ..... 250/559; 250/571; 356/434

[58] Field of Search ..... 250/559, 571; 356/429, 356/432–434, 238; 112/153

[56] References Cited

U.S. PATENT DOCUMENTS 3,609,373 9/1971 Desai .
4,237,378 12/1980 Jones ..... 356/434
4,248,168 2/1981 Hoffman .
4,380,390 4/1983 Arndt et al. ..... 356/434
4,696,246 9/1987 Rohr et al. ..... 250/561

FOREIGN PATENT DOCUMENTS 3224314 4/1983 Fed. Rep. of Germany .
2157594 6/1973 France .
2179537 11/1973 France .
2503201 10/1982 France .

*Primary Examiner*—Davis L. Willis
*Attorney, Agent, or Firm*—Christel, Bean & Linihan

[57] ABSTRACT

A device for detecting a thickness variation of a piece of fabric passing under the presser foot of a sewing machine. The device includes a transmitter and receiver between which the fabric passes. The receiver stores maximum and minimum signals in memory units generated when the fabric passes between the transmitter and receiver. A computing unit calibrates the thresholds as a function of the stored maximum and minimum signals. A comparator compares the incoming signals with the calibrated thresholds and sends a signal to a logic unit to control the sewing operations accordingly.

10 Claims, 1 Drawing Sheet

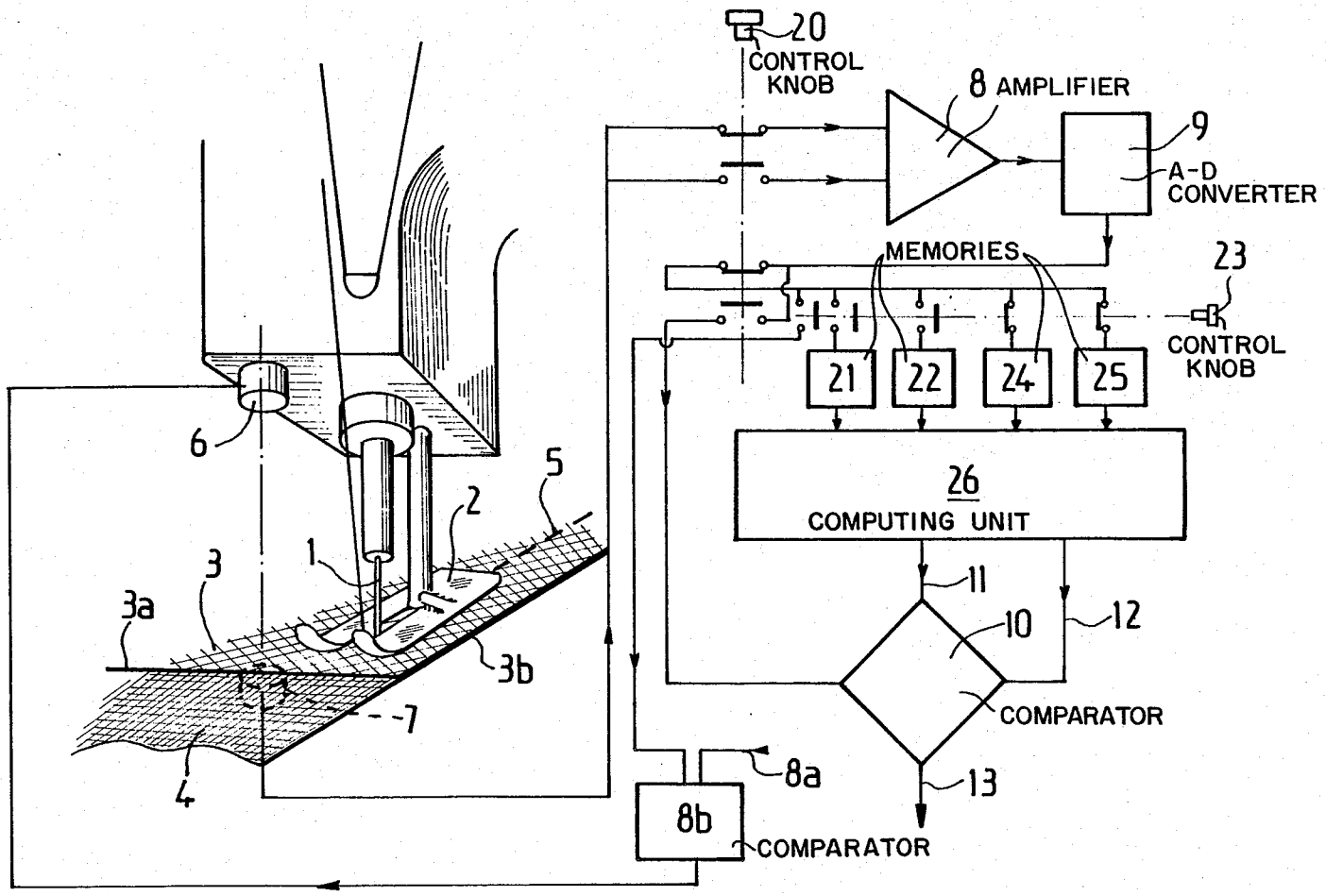
8 AMPLIFIER
9
A-D CONVERTER
20
CONTROL KNOB
23
CONTROL KNOB
MEMORIES
21
22
24
25
26
COMPUTING UNIT
11
10
12
COMPARATOR
13
COMPARATOR
8a
8b
1
2
3
3a
3b
4
5
6
7

DEVICE FOR DETECTING THE VARIATION OF THICKNESS OF A FABRIC AND A PROCESS FOR CALIBRATING SAME

BACKGROUND OF THE INVENTION

Numerous sewing and oversewing operations are performed parallel to the edge of a piece of fabric. The fabric edge may comprise angles which require stopping of the sewing at a given distance from one of the sides of the angle, rotation of the workpiece being sewn, stitching again as far as the next angle, and so on.

Automation of this kind of stitching requires the capability of stopping the operation at a specific distance from the edge of the fabric and the capability of detecting the passage of this edge opposite a given point with respect to the needle. It is relatively simple to detect a clean edge of a tight opaque fabric. It is much more difficult to detect the same edge of a very transparent fabric and especially the edge of a second thickness of fabric to be sewn on a background, as in the case of pockets to be applied to clothes.

Numerous devices exist which are capable of detecting the edge of a piece of fabric when the edge appears. One such device employs a photoelectric cell situated opposite a transmitter. The accuracy of such devices is known to be relatively uncertain and their behavior varies enormously from one piece of fabric to another. It is also known to use similar apparatus emitting and receiving infrared radiation for detecting thickness variations and for defining a signal indicating the passage of an edge during an operation of applying one thickness on another. The accuracy of such an apparatus is low and requires a very long time to adapt the sensitivity of the apparatus to the nature of the fabric sewn, depending on whether the fabric is more or less opaque.

The present invention relates to an important improvement in the above described detectors of the second type by means of a device using signals received by the "cell" which makes it extremely simple to adapt the detector to different fabrics and which allows a sharp signal to be obtained from the device and which is simple to use in a logic circuit for driving a power device.

SUMMARY OF THE INVENTION

To this end, the invention provides a device for detecting the variation of thickness of a piece of fabric passing under the presser foot of a sewing machine and for emitting a signal to a logic device controlling the sewing operations across the thickness variation. According to the essential features of the invention, there is provided a signal transmitter and a receiver between which the fabric passes and a device using the level of the signals received by the receiver comprising means for storing the maximum and minimum of the signala, controlled manually during calibration operations, a device calculating thresholds as a function of the minimum and maximum signals stored, and a comparator for comparing the signals read with the determined thresholds and for sending a control signal to the logic device when the signal becomes less or greater than the calculated low threshold and the calculated high threshold, respectively.

The device of the invention is very readily and quickly adjusted in its sensitivity as a function of the nature of the opacity and thickness of the fabric.

The invention also provides a process for calibrating the detection device consisting in establishing two detection thresholds corresponding, respectively, to a first fabric thickness and to a second fabric thickness. In this method, the strength of the signals emitted in the presence of the smallest thickness to be detected is adjusted and, for each fabric thickness, a plurality of values are read. Then the maximum and minimum values read are recorded and, using a computing means, the thresholds are determined the minimum value relative to the smallest fabric thickness and the maximum value relative to the greatest fabric thickness. Preferably, the minimum and maximum values are digitized before storage.

In a preferred embodiment, the upper threshold corresponds to the minimum value relative to the smallest fabric thickness reduced by a quarter of the value of the difference between the minimum value and the maximum value relative to the greatest fabric thickness. The lower threshold corresponds to the maximum value relative to the largest fabric thickness increased by a quarter of the value of the difference between the minimum value and a maximum value relative to the greatest fabric thickness. One of the quickest and surest means for obtaining the plurality of values required for calibrating the thresholds consists in moving the fabric thicknesses in front of the detection device.

The invention will be illustrated in greater detail by one embodiment described hereafter by way of a non-limiting example which will show the advantages and secondary characteristics.

BRIEF DESCRIPTION OF THE DRAWING

The single feature of the drawing, partly in perspective and partly schematic, illustrates the device and method of the present invention.

DETAILED DESCRIPTION OF THE ILLUSTRATED EMBODIMENT

Referring to the drawing, a sewing head H of a sewing machine is shown comprising a needle 1 and a presser foot 2 under which are placed two pieces of fabric 3 and 4 during assembly by stitching 5. The piece of material 3 has an edge 3*a* substantially perpendicular to its edge 3*b* along which the stitching 5 is made. In order to continue the assembly of pieces 3 and 4 by stitching parallel to edge 3*a*, the stitching 5 should be stopped at a given distance from edge 3*a* so as to turn the piece and sew along this edge. Automation of the operation requires knowing the moment when the edge 3*a* arrives at a fixed distance from the needle 1. For this, a detector is disposed in the vicinity of needle 1 for detecting the variation in thickness of the material. In the present illustration the detector comprises an infrared radiation transmitter 6 and, directly therebelow is a receiver 7 for receiving the transmitted radiation. The receiver 7 may be housed in the needle plate and may be a phototransistor or an end of an optical fiber connected to a phototransistor. There is provided means for adjusting the strength of the radiation produced by transmitter 6 comprising a comparator 8*b* integrated in a microprocessor driving the sewing machine. The method of using comparator 8*b* will be discussed further on.

The principle of detection is based on the fact that the opacity of two thicknesses of fabric is greater than that of a single thickness. This causes a variation of the level of signals received by receiver 7 when edge 3*a* passes. This level variation is then used for generating a signal transmitted to the microprocessor controlling the sewing machine.

It will be readily understood that the strength of the radiation received by receiver 7, and thus the variation of this strength when edge 3*a* passes, depends on the nature of the material. It is therefore necessary, so as to able to use the detector in the presence of fabrics of different kinds, provided of course that they do not form a total screen to the radiation, to provide means for adapting the detector to the different fabric materials and in a simple way.

According to the present invention, the radiation received by receiver 7 is converted into an electric signal in a known way and amplified by means of a constant gain amplifier 8. The output signal from amplifier 8 is then fed to the input of an A–D converter 9. The output of this converter is connected to the input of a comparator 10. This digitized signal fed into comparator 10 is compared with two reference values, fed into the comparator at 11 and 12. The state of the output 13 of the comparator changes when the digitized signal delivered by receiver 7 passes from an upper level at the high reference value 11 to a lower level at the low reference value 12 and conversely. This change of state forms a signal which is used by the microprocessor (not shown) for controlling the machine.

The reference values depend essentially on the nature of the fabrics worked and must be provided for each material. To provide these reference values, the invention comprises a procedure for calibrating the apparatus in which signals obtained from the fabrics in question are stored and reference values, i.e. thresholds, are calculated from these stored signals. For this, the device is provided with a manual control knob 20 to select either a "recording" position for determining the reference values, i.e. thresholds, or a detection position as shown in the drawings when the fabric is being sewn.

For example,, a suitable fabric thickness is placed between the transmitter 6 and receiver 7 for recording and determining the reference values, i.e. thresholds. The amplifier 8 has a saturation threshold 8*a* which is fed into the input of comparator 8*b*. Further, the output signal from amplifier 8, which is processed by the A-D converter 9, is also fed to the input of comparator 8*b* and compared with the saturation threshold 8*a*. The strength of the radiation produced by transmitter 6 is adjusted to make the output signal of the amplifier 8 substantially equal to the saturation threshold 8*a*. The fabric thickness is then moved for a few sections to take into account the heterogeneities of the material. The output signal from receiver 7 is variable over a range limited by a maximum value and a minimum value which are separately but indiscriminately stored in digital form in memories 21 and 22. A manual control knob 23 is actuated from the position which it occupies in the figure to provide the connection between the A-D converter 9 and comparator 8*b*, and for selecting the memories 21 and 22. After selecting the memories 24 and 25 as illustrated in the drawing, the maximum digitized value and the minimum digitized value of the output signal of receiver 7 are stored in memories 24 and 25, respectively for two fabric thicknesses. These values also are obtained by the moving fabric.

A computing unit 26, which is part of the microprocessor controlling the machine, provides reference values 11 and 12 in the following way. First, it determines among the two extreme values relative to a fabric thickness and stored in memories 21 and 22 which value is the smallest. This value forms the minimum value stored "A" of the signal emitted by receiver 7. It then determines in similar fashion, by comparing the contents of memories 24, 25, the maximum value stored "a" of the signal emitted by receiver 7 in the presence of two fabric thicknesses.

Computing unit 26 then works out the arithmetic mean M between the minimum value A and the maximum value a. It calculates finally the arithmetic means between this mean value M and the minimum value A so as to obtain the high reference value and calculates the arithmetic means between the mean value M and the maximum value a so as to obtain the low reference value, in accordance with the following equations:

$$M = \frac{a + A}{2}$$

high reference value $$= \frac{M + A}{2} = \frac{a}{4} + \frac{3A}{4} = A - \frac{1}{4}(A - a)$$

low reference value $$= \frac{M + a}{2} = \frac{A}{4} + \frac{3a}{4} = a + \frac{1}{4}(A - a)$$

It is noted that the high reference value may also be defined as being equal to the minimum value "A", reduced by a quarter of the value of the difference between the minimum value "A" and the maximum value "a". Similarly, the low reference value is equal to the maximum value "a", increased by a quarter of the value of the difference between minimum value "A" and maximum value "a". Using this method of determination, it is certain thresholds can be obtained which will be crossed only when a variation of thickness is detected, and not because of uncertainties in the homogeneity of the fabrics.

The detection of the variation of the thickness between one and two layers of fabrics has been described above, but the invention also applies to the detection of the edge of a single thickness of fabric. In this case, the device is calibrated i.e., determination of reference values, in the same way by adjusting the radiation level and by storing the high values in the absence of fabric, during a few seconds so as to take into account possible parasites, and by recording the low values in the presence of the fabric layer which is moved under the detector, also for a few seconds.

This invention is applicable in the ready to wear and furnishing industries where numerous repetitive stitching operations are required.

I claim:

1. Device for detecting the variation of thickness of a plurality of fabric layers (3, 4) each having a thickness and passing under the present foot (2) of a sewing machine during a sewing operation, comprising a signal transmitter (6) and a receiver (7) between which said fabric (3, 4) passes, and a device using the level of the signal received by the receiver (7), for sending a control signal to a logic device controlling the sewing operation when passing over said variation of thickness, characterized in that said device comprises means (23, 21, 22, 24, 25) for reading a plurality of values of said signal corresponding to each of said thicknesses of said fabric layers and storing the minimum value (A) relative to the smallest fabric layer thickness and the maximum value (a) relative to the largest fabric layer thickness during a calibration operation, a device (26) for calculating a high (11) and a low (12) thresholds which are a function of and which lie between said minimum and maximum values (A,a), and a comparator (10) comparing the signal read during said sewing operation with said thresholds (11,12) and sending said control signal (13) to said logic device when the signal read passes from a level higher than said high threshold (11) to a level lower than said low threshold (12), or conversely.

2. Device according to claim 1, wherein said high threshold (11) is equal to said minimum value reduced by a quarter of the value of the difference between said minimum and maximum values, and said low threshold (12) is equal to said maximum value increased by a quarter of the value of said difference.

3. Device according to claim 1, adapted to read said plurality of values of said signal corresponding to each fabric thickness as the fabric is moved between said transmitter and said receiver during a predetermined space of time.

4. Device according to claim 1, comprising an amplifier (8) for amplifying said signal received by the receiver (7), and a comparator (**8*b*) for comparing an output signal from said amplifier corresponding to the smallest fabric thickness with a saturation threshold (8*a***) of said amplifier and for producing a signal for adjusting the strength of the radiation produced by said transmitter so as to make said output signal substantially equal to said saturation threshold, during said calibration operation.

5. Apparatus for detecting the edge of a fabric passing under the presser foot of a sewing machine during a sewing operation, comprising a signal transmitter and a receiver between which said fabric passes, and control means using the level of the signal received by the receiver for sending a control signal to a logic device controlling the sewing operation when passing over a variation of thickness, wherein said control means comprises means for reading a plurality of values of said signal in the absence of fabric and in the presence of fabric and storing the minimum value (A) relative to the absence of fabric and the maximum value (a) relative to the presence of fabric during a calibration operation, computing means (26) for calculating a high (11) and a low (12) thresholds which are a function of and which lie between said minimum and maximum values (A,a), and a comparator (10) comparing the signal read during said sewing operation with said thresholds (11, 12) and sending said control signal (13) to said logic device when the signal read passes from a level higher than said high threshold (11) to a level lower than said low threshold (12), or conversely.

6. Apparatus according to claim 5, adapted to read said plurality of values of said signal in the absence of fabric during a predetermined space of time, and said plurality of values of said signal in the presence of fabric as the latter is moved between said transmitter and said receiver during a predetermined space of time.

7. A method of calibrating a device for detecting the variation of thickness of a plurality of fabric layers (3, 4) each having a thickness and passing under the presser foot (2) of a sewing machine during a sewing operation including a signal transmitter (6) and a receiver (7) between which said fabric (3, 4) passes wherein the level of the signal received by the receiver contains information pertaining to the fabric thickness, comprising the steps of: providing two detection thresholds (11, 12) corresponding respectively to a first fabric thickness (3, 4) and a second fabric thickness (4), providing a signal for adjusting the strength of signals emitted from said receiver in the presence of the smallest fabric thickness to be detected, reading a plurality of values for each fabric thickness, storing (21m, 22, 24, 25) the maximum and minimum values read, and determining said thresholds (11, 12) by means of a computing device (10) between the minimum value relative to the smallest fabric thickness and the maximum value relative to the largest fabric thickness.

8. Method according to claim 7, characterized in that said minimum and maximum values are digitized (8) before storage.

9. Method according to claim 7, characterized in that said thresholds (11, 12) correspond for the upper threshold (11) to the minimum value relative to the smallest fabric thickness reduced by a quarter of the value of the difference between said minimum value and the maximum value relative to the largest fabric thickness and for the lower threshold (12) to the maximum value relative to the largest fabric thickness increased by a quarter of the value of said difference.

10. The method according to claim 7, characterized in that the plurality of said values read is obtained by moving fabric thicknesses (3 and 3,4) under the detection device (6, 7).

* * * * *